United States Patent [19]

Lipparini et al.

[11] Patent Number: 4,865,387

[45] Date of Patent: Sep. 12, 1989

[54] ARTICULATED SUPPORT ROD FOR FORWARD FOLDING BACKS OF SEATS SUCH AS SOFA, ARMCHAIR OR THE LIKE

[76] Inventors: Mauro Lipparini, 46, Via Brigate Partigiane, Grosseto; Roberto Tapinassi, 1, Via IX Febbraio, Florence, both of Italy

[21] Appl. No.: 203,624

[22] Filed: Jun. 2, 1988

[30] Foreign Application Priority Data

Jun. 5, 1987 [IT] Italy ..... 11658/87[U]

[51] Int. Cl.[4] ..... B60N 1/02

[52] U.S. Cl. ..... 297/378; 5/12 R; 297/284

[58] Field of Search ..... 297/378, 284, 118, 445; 5/12 R, 51 G, 51 J

[56] References Cited

U.S. PATENT DOCUMENTS 3,379,472 4/1968 Hilfiker ..... 297/284

4,585,272 3/1986 Ballarini ..... 297/284

FOREIGN PATENT DOCUMENTS 257094 2/1928 Italy ..... 297/284

*Primary Examiner*—James T. McCall

*Attorney, Agent, or Firm*—Browdy and Neimark

[57] ABSTRACT

An articulated support rod fit for realizing the frame of a forward folding back of a seat, such as sofa, armchairs or the like. The rod is formed by a row of arms connected in an end-to-end relation by means of a frictional articulation, and comprises means for the connection to the main frame of the seat and, at the free end, a flat elongated plate, which may be either thick or thin according to the material used. Each arm comprises stop means at its end sides engaging with corresponding stop means provided on the corresponding end side of adjacent arms, to limit the mutual rotation of the arms to a first position wherein they are substantially aligned and to a second position where each arm is inclined with respect to the adjacent one of an angle lower than 90°.

7 Claims, 2 Drawing Sheets

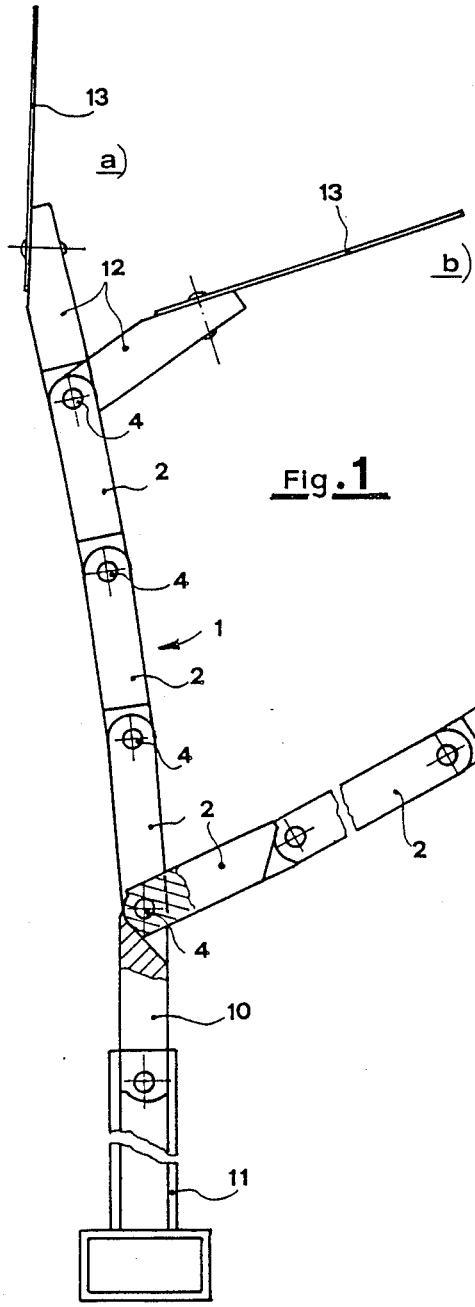
Fig. 1
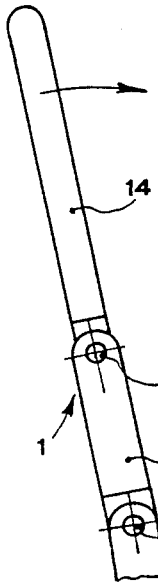
Fig. 7
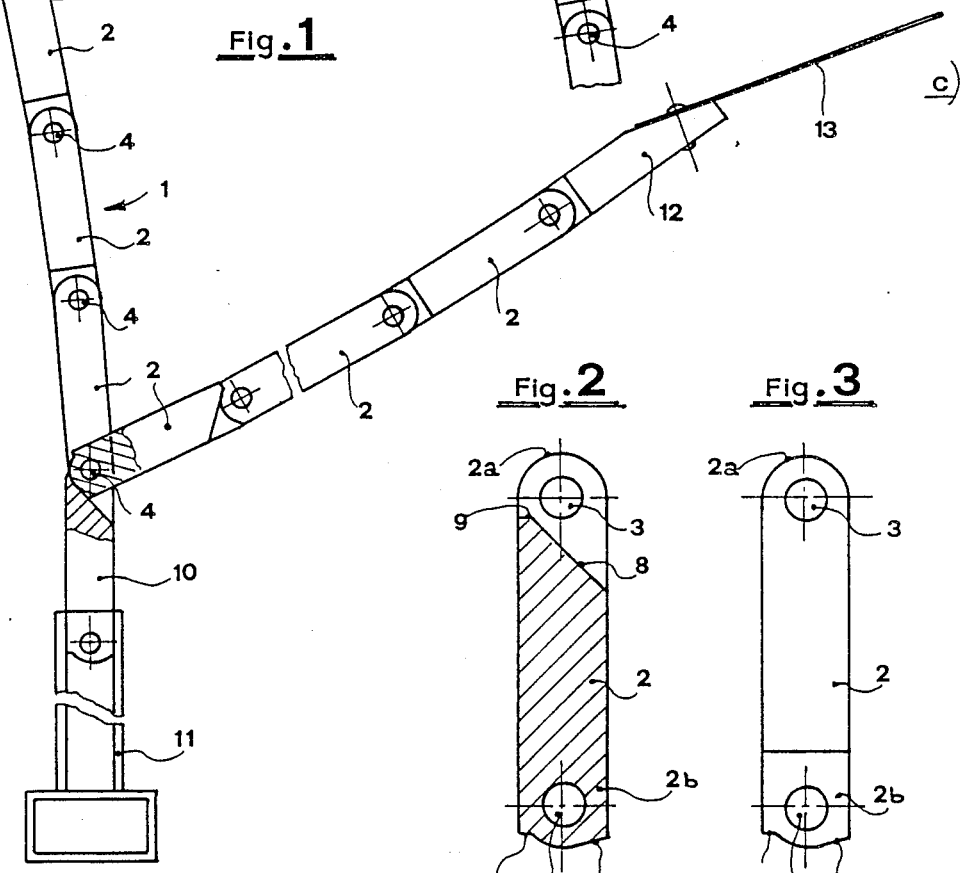
Fig. 2
Fig. 3

ARTICULATED SUPPORT ROD FOR FORWARD FOLDING BACKS OF SEATS SUCH AS SOFA, ARMCHAIR OR THE LIKE

DESCRIPTION

1. Field of the invention

The present invention relates to an articulated support rod designed to constitute the internal frame for a forward folding back, in particular of sofa, armchairs or the like.

2. Status of the art

Hitherto, the manufacture of sofa, armchairs or the like fit for being folded forward comprises the use of a frame embedded in the panel forming the back, said frame including releasable articulations allowing for the back to be gradually moved from a substantially vertical attitude to that folded forward. In this way a rest sofa, i.e. with upright back, can be easily and advantageously transformed into a conversation sofa, i.e. with low back. The convertible sofa, as explained above, of the conventional type are proven very hard to operate because a often not negligible effort is necessary to release the trips of the articulation. Furthermore the known type of convertible sofas presents a support surface not sufficiently comfortable, particularly in correspondance of two adjacent backs, due to the dimension and shape of the internal frame and articulation.

The purpose of the present invention is to provide an articulated support rod for manufacturing seat backs for sofas, armchairs or the like suitable of being forward folded without effort from an upright attitude to a substantially horizontal position and capable of offering the greatest comfort.

SUMMARY OF THE INVENTION

The main feature of the articulated support rod according to the invention consists in that it is formed by a plurality of arms connected to one another in a end-to-end relation by means of frictional articulations, which are able to offer moderate resistance to the rotation. The end arms of the rod are provided with means for fastening the rod to the main structure of the sofa and, respectively, with an axially extending elongated flat member. Furthermore, in correspondance of each articulation, stop means are provided for limiting the rotation of two adjacent arms between two angularly spaced apart positions, namely a first position wherein said two arms are substantially aligned to one another and a second position wherein one of them forms an acute angle with respect to the common alignment axis. The angle is generally comprised between 30° and 60° and in a preferred embodiment of the invention is 45°.

BRIEF DESCRIPTION OF THE DRAWINGS

The invention will now be described in more detail with the following description of an exemplifying and notlimiting embodiment made with reference to the attached drawings, wherein:

FIG. 1 is an elevation side view of the articulated support rod according to the invention shown in (a) a substantially upright attitude, and (b), (c) two partially folded attitudes with different inclination;

FIGS. 2 and 3 are respectively a sectional view and a side view of an arm forming the support rod according to the invention;

FIG. 7 is an alternative embodiment of the free terminal portion of the support rod according to the invention.

DESCRIPTION OF A PREFERRED EMBODIMENT

Figure 4:
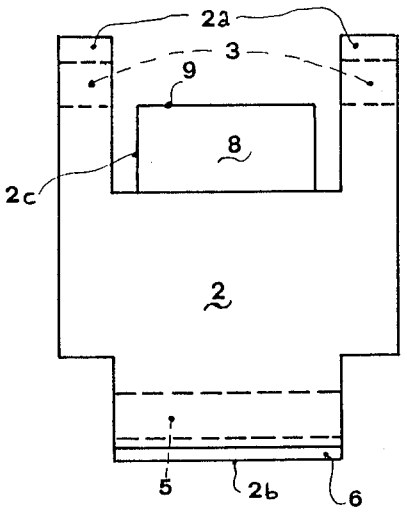
FIG. 4 and 5 are respectively a front and a rear view of an arm forming the support rod according to the invention.
Figure 5:
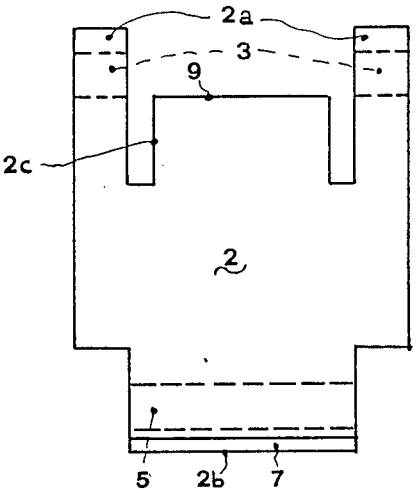

With reference to the above mentioned drawings, it has been generally indicated at 1 a support rod formed by arms 2 connected to one another in a end-to-end relation in an articulated way. More particularly, each arm 2 is formed by a generally quadrilateral thick plate, possibly of elongated shape, having two opposite ends shaped in such a way to form the members of the articulation. In particular, one end side of arm 2 is shaped like a fork **2*a* in which two aligned through-holes 3 are formed for housing a pivot 4 of the articulation. To the other end side of arm 2 an intermediate expansion 2*b* is provided for engaging within fork 2*a*, in said expansion 2*b* a through hole 5 being formed in such a way that, when the expansion 2*b* of one arm 2 is engaged within the forked end 2*a* of an adjacent arm 2, through holes 3 and 5 are aligned to one another and the pivot 3** can be housed therein. The articulation as above described is realized in such a way to provide for a certain degree of friction so as to assume a sufficient stability to the back in every attitude in which it may be positioned. The degree of friction is however not excessive so as to allow a easy arrangement of the back in the desired position. The frictional articulation used for the purpose of the invention is of the conventional type and is not described in detail.

The free end of expansion **2*b* of arm 2 has a front stop face 6 inclined with respect to the horizontal plane, and a rear stop face 7 parallel to the horizontal plane. Correspondingly on the opposite end side arm 2 fork 2*a* includes an expansion 2*c* on which a further inclined front stop face 8 and a further rear stop face 9, parallel to the horizontal plane are formed. On connecting two arms 2 by means of the above mentioned articulation, stop faces 6 and 7 of expansion 2*b* engage with respective stop faces 8 and 9 of expansion 2*c* thus limiting the mutual rotation both in the clockwise and in the anticlockwise direction. In particular, due to the mutual engagement of the stop faces 7 and 9, two adjacent arms can not rotate beyond a position wherein they are substantially aligned, whereas their clockwise rotation is limited by the inclined stop faces 6 and 8 which allow for a maximum angular displacement lower than 90°, generally comprised between 30°and 60° and preferably equal to 45°, with respect to the alignment axis. Preferably, rear stop faces 7 and 9, are slightly inclined (few degrees with respect to the horizontal), whereby the support rod, when positioned in its substantially vertical attitude, is slightly rearward leaning, as shown in FIG. 1, to improve its comfort. One of the end arms of the rod 1, indicated at 10, is connected to a foot 11 for firmly securing the rod to the structure of the sofa in any conventional way. To the other end arm 12 of rod 1 there is fixed a thin elongated plate 13 of flexible material extending therefrom in a substantially axial relation. Plate 13** assures a suitable flexibility to the upper portion of the back without compromising its consistency.

Figure 6:
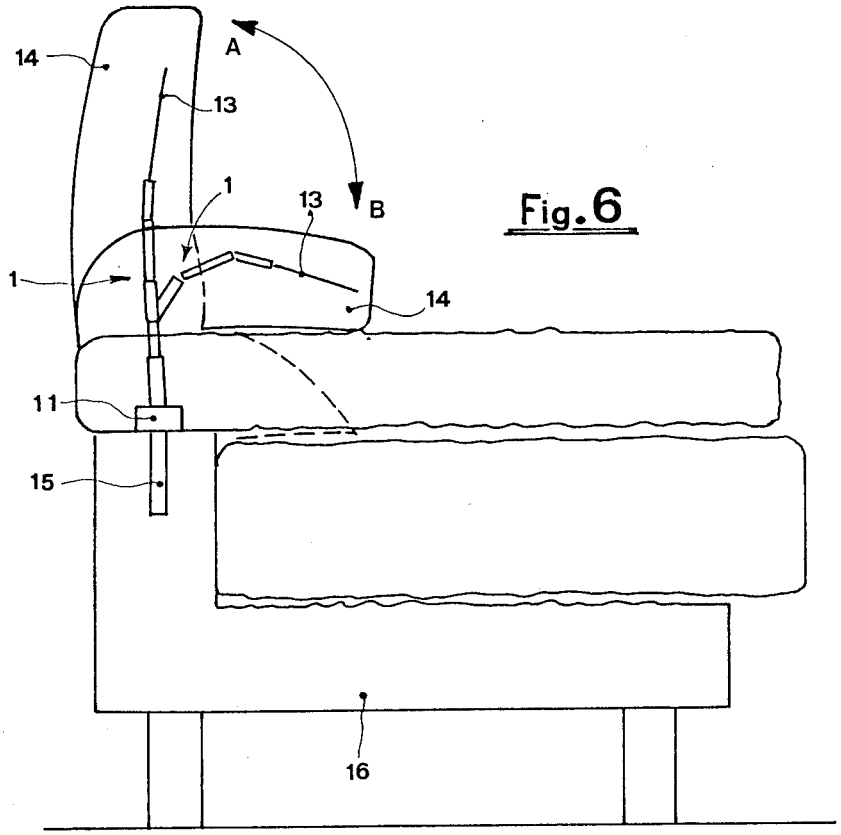
FIG. 6 is a schematic side elevational view of a sofa with foldable back incorporating the support rod according to the invention; and p

As shown schematically in FIG. 6, support rod 1 is embedded in the back panel 14 (generally a back framework is constituted by at least a pair of support rods 1) and fixed with the base foot 11 to the main frame 15 embedded in the body of the sofa. Once the back 14 is displaced from the upright position, indicated at A, to the forward leant position, indicated at B, arms 2 gradually rotate with respect to one another up to the position allowed by the inclined stop faces 6 and 8 forcing against each other. The first arm to start rotating is the end arm 12, i.e. the arm closest to the elongated plate 13. When arm 12 has reached the position corresponding to the maximum allowed rotation with respect to the adjacent arm, the latter is in turn caused to rotate and so forth until the back is forward folded. When the back is in this position, arms 2 of rod 1 closest to the base foot 11 have not reached their mutual maximum inclination, thus maintaining a residual possibility of rotation. As a result of that, the back is suitably flexible and comfortable even when it is in its forward leant attitude.

Furthermore, it has to be pointed out that, when arranged in the forward folded position, the thin elongated plate 13 is directed downward, whereby, by resting with the body to the back, said plate tends to yield in a natural way anyway providing for a comfortable support surface. Finally, the articulated support rod according to the invention, due to its essentially flat shape and flexibility, is in practice imperceptible from the outside, whereby any sitting position on the sofa is equally comfortable. According to the alternative embodiment shown in FIG. 7, the elongated plate 13 of flexible material is substituted by an elongated arm 14 substantially of the same length of the thin plate 13, but made of the same material of the rod arms 2 and substantially of the same thickness. This has proven particularly advantageous when the material has some degree of flexibility, for instance when polycarbonate is used. On the other hand when a rigid material, such as aluminium, is used, the use of the thin elongated plate 13 is preferred.

The invention is not to be considered as being limited by the embodiment described herein and it is understood that it comprises any form of variation or modification which falls within the scope of the claims appended hereto.

We claim:

1. An articulated support and rod for the internal frame of forwardly folding backs of seats, such as sofa, armchair or the like, comprising a row of at least three arms connected in an end-to-end relation by means of frictional articulation through a pair of sliding contact surfaces having sufficient friction therebetween so as to maintain stable positioning of each arm in any position relative to a next adjacent arm, one of the end arms of said row being connected to means for securing the rod to the main frame of the sofa, armchair or the like, the other end arm having an axially extending, flat elongated plate, stop means in correspondence with each articulation being further provided for limiting the rotation of two adjacent arms between a first position, in which they are substantially vertically aligned, and a second position, in which an upper arm folds forwardly, and forms an acute angle with a lower arm with respect to the common alignment axis thereof.

2. An articulated support rod for the internal frame of forwardly folding backs of seats, such as sofa, armchair or the like, comprising a row of arms connected in an end-to-end relation by means of frictional articulation, one of the end arms of said row being connected to means for securing the rod to the main frame of the sofa, armchair or the like, the other end arm having an axially extending, flat elongated plate, stop means in correspondence with each articulation being further provided for limiting the rotation of two adjacent arms between a first position, in which they are substantially aligned, and a second position, in which one arm forms an acute angle with the other arm with respect to the common alignment axis thereof, wherein each of said arms is formed by a substantially quadrilateral plate one end side of which is shaped like a fork, the opposite end side comprising an expansion of a width substantially equal to the width of said fork, transverse-holes being formed through said expansion and said fork to be axially aligned for providing for the seat of pivot of said articulation.

3. Articulated support rod according to the claim 2, wherein the free edge of said expansion has a rear stop face and a front stop face inclined with respect to the rear stop face, while within said fork corresponding further rear and front stop faces are formed, whereby, by mutually connecting a pair of said arms by means of said articulation, the rear stop face of said expansion engages with the rear stop face of said fork to limit the rotation to said first position, the front stop face of said expansion engaging further with the front stop face of said fork to limit the rotation to said second position.

4. Articulated support rod according to the claim 2, wherein the inclination of said front stop faces is such that the maximum angular displacement of an arm with respect to the common alignment axis is lower than 90° and preferably comprised between 30° and 60°.

5. Articulated support rod according to the claim 2, wherein said rear stop faces have a minimum inclination, whereby, when the rod is in its aligned attitude, each arm is few degree rearward inclined with respect to the previous one so that the rod is slightly leant rearward.

6. An articulated support rod for the internal frame of forwardly folding backs of seats, such as sofa, armchair or the like, comprising a row of arms connected in an end-to-end relation by means of frictional articulation, one of the end arms of said row being connected to means for securing the rod to the main frame of the sofa, armchair or the like, the other end arm having an axially extending, flat elongated plate, stop means in correspondence with each articulation being further provided for limiting the rotation of two adjacent arms between a first position, in which they are substantially aligned, and a second position, in which one arm forms an acute angle with the other arm with respect to the common alignment axis thereof, wherein said flat elongated plate is a flexible thin plate, said arms being made up of rigid material.

7. An articulated support rod for the internal frame of forwardly folding backs of seats, such as sofa, armchair or the like, comprising a row of arms connected in an end-to-end relation by means of frictional articulation, one of the end arms of said row being connected to means for securing the rod to the main frame of the sofa, armchair or the like, the other end arm having an axially extending, flat elongated plate, stop means in correspondence with each articulation being further provided for limiting the rotation of two adjacent arms between a first position, in which they are substantially aligned, and a second position, in which one arm forms an acute angle with the other arm with respect to the common alignment axis thereof, wherein said flat elongated plate and said arm are both made up of a limited flexibility material.

* * * * *